US007595107B2

(12) United States Patent
Kalkanoglu et al.

(10) Patent No.: US 7,595,107 B2
(45) Date of Patent: Sep. 29, 2009

(54) ALGAE RESISTANT ROOFING SYSTEM CONTAINING SILVER COMPOUNDS, ALGAE RESISTANT SHINGLES, AND PROCESS FOR PRODUCING SAME

(75) Inventors: Husnu M. Kalkanoglu, Swarthmore, PA (US); Keith C. Hong, Lititz, PA (US); Ming Liang Shiao, Collegeville, PA (US); Gregory F. Jacobs, Oreland, PA (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 11/611,939

(22) Filed: Dec. 18, 2006

(65) Prior Publication Data

US 2007/0148340 A1 Jun. 28, 2007

Related U.S. Application Data

(60) Provisional application No. 60/597,894, filed on Dec. 22, 2005.

(51) Int. Cl.
*B32B 5/66* (2006.01)

(52) U.S. Cl. ..... 428/402; 428/403; 428/404; 428/405; 428/406; 428/407; 427/212; 427/213.32

(58) Field of Classification Search ..... 428/402–407; 427/212, 213.32
See application file for complete search history.

(56) References Cited

U.S. PATENT DOCUMENTS

| | | | | |
|---|---|---|---|---|
| 2,591,149 | A | | 4/1952 | Grove |
| 2,614,051 | A | | 10/1952 | Buzzell et al. |
| 2,898,232 | A | | 6/1959 | Miller et al. |
| 2,981,636 | A | | 2/1961 | Lodge et al. |
| 2,978,340 | A | | 4/1961 | Veatch et al. |
| 3,030,215 | A | | 4/1962 | Veatch et al. |
| 3,129,086 | A | | 4/1964 | Veatch et al. |
| 3,230,064 | A | | 1/1966 | Veatch et al. |
| 3,365,315 | A | | 1/1968 | Beck et al. |
| 3,507,676 | A | * | 4/1970 | McMahon ..... 428/145 |
| 3,792,136 | A | | 2/1974 | Schmitt |
| 4,111,713 | A | | 9/1978 | Beck |
| 4,279,632 | A | | 7/1981 | Frosch et al. |
| 4,391,646 | A | | 7/1983 | Howell |
| 4,744,831 | A | | 5/1988 | Beck |
| 4,767,726 | A | | 8/1988 | Marshall |
| 5,077,241 | A | | 12/1991 | Moh et al. |
| 5,180,585 | A | | 1/1993 | Jacobson et al. |
| 5,356,664 | A | * | 10/1994 | Narayan et al. ..... 427/186 |
| 5,503,840 | A | | 4/1996 | Jacobson et al. |
| 5,595,750 | A | | 1/1997 | Jacobson et al. |
| 6,143,318 | A | | 11/2000 | Gilchrist et al. |
| 6,156,245 | A | | 12/2000 | Takebayashi et al. |
| 6,797,277 | B2 | | 9/2004 | Heier et al. |
| 6,861,145 | B2 | | 3/2005 | Nastke et al. |
| 6,936,644 | B2 | | 8/2005 | Gilleo |
| 2008/0131664 | A1 | | 6/2008 | Teng et al. |

FOREIGN PATENT DOCUMENTS

WO 2008045992 A1 4/2008

OTHER PUBLICATIONS

G. Beestman, "Microencapsulation of Solid Particles" (H. B. Scher, Ed., Marcel Dekker, Inc., New York, 1999) pp. 31-54.

* cited by examiner

*Primary Examiner*—Leszek Kiliman
(74) *Attorney, Agent, or Firm*—Paul & Paul

(57) ABSTRACT

Algae-resistant roofing granules include inert base particles with an exterior coating including high-surface area silver as a biocide.

22 Claims, 3 Drawing Sheets

ALGAE RESISTANT ROOFING SYSTEM CONTAINING SILVER COMPOUNDS, ALGAE RESISTANT SHINGLES, AND PROCESS FOR PRODUCING SAME

CROSS-REFERENCE TO RELATED APPLICATION

The present application claims the priority of U.S. Provisional Patent Application 60/597,894 filed Dec. 22, 2005.

BACKGROUND OF THE INVENTION

1. Field of the Invention

The present invention relates to asphalt roofing shingles, protective granules for such shingles, and processes for makings such granules and shingles.

2. Brief Description of the Prior Art

Pigment-coated mineral rocks are commonly used as color granules in roofing applications to provide aesthetic as well as protective functions to the asphalt shingles. Dark blotches or streaks sometimes appear on the surfaces of asphalt shingles, especially in warmer humid climates, because of the growth of algae and other microorganisms. The predominant species responsible is *Gloeocapsa magma*, a blue-green algae. Eventually, severe discoloration of the entire roof can occur.

Various methods have been used in an attempt to remedy the roofing discoloration. For example, topical treatments with organic algaecides have been used. However, such topical treatments are usually effective only for short term, typically one to two years. Another approach is to add algaecidal metal oxides to the color granule coatings. This approach is likely to provide longer protection, for example, as long as ten years.

Companies, including Minnesota Mining and Manufacturing (3M) and GAF Materials Corporation/ISP Mineral Products Inc., have commercialized several algaecide granules that are effective in inhibiting algae growth.

A common method used to prepare algae-resistant (AR) roofing granules generally involves two major steps. In the first step, metal oxides such as cuprous oxide and/or zinc oxide are added to a clay and alkali metal silicate mixture. The mixture in turn is used to coat crushed mineral rocks. The mixture is rendered insoluble on the rock surfaces by firing at high temperatures, such as about 500° C., to provide a ceramic coating. In the second step, the oxides covered rocks are coated with various color pigments to form colored algae-resistant roofing granules. The algae-resistant granules, alone, or in a mixture with conventional granules, are then used in the manufacture of asphalt shingles using conventional techniques. The presence of the algae-resistant granules confers algae-resistance on the shingles.

Roofing granules typically comprise crushed and screened mineral materials, which are subsequently coated with a binder containing one or more coloring pigments, such as suitable metal oxides. The binder can be a soluble alkaline silicate that is subsequently insolubilized by heat or by chemical reaction, such as by reaction between an acidic material and the alkaline silicate, resulting in an insoluble colored coating on the mineral particles.

U.S. Pat. No. 3,507,676 discloses roofing granules containing zinc, zinc oxide, or zinc sulfide, as an algaecide and fungicide.

Algae resistant shingles are disclosed, for example, in U.S. Pat. No. 5,356,664 assigned to Minnesota Mining and Manufacturing Co., which discloses the use of a blend of algae-resistant granules and non-algae-resistant granules. The algae-resistant granules have an inner ceramic coating comprising cuprous oxide and an outer seal coating initially devoid of copper.

There is a continuing need for algae-resistant roofing products having algaecide leaching rates that can be controlled so that the roofing products can be tailored for specific local conditions.

SUMMARY OF THE INVENTION

The present invention provides algae-resistant roofing granules, algae-resistant sheet roofing products such as asphalt shingles and roofing membranes, and processes for make such products. Algae-resistance is provided by metallic silver or silver compounds having a high surface area.

In one presently preferred embodiment of the present invention, the algae-resistant sheet roofing products include algae-resistant roofing granules. These roofing granules are formed from base particles comprising an inert mineral which are coated with an exterior coating layer. The exterior coating includes biocidal particles which are selected from (1) biocidal particles having an average size from about 0.1 micrometers to about 5 millimeters and having a surface coating comprising at least one silver biocide; and (2) microcapsules having an average size from about 200 micrometers and 5 millimeters. The microcapsules preferably have capsule walls that are environmentally degradable in a controlled manner, and cores including a plurality of biocidal particles. The biocidal particles preferably have an average size from about 0.1 micrometers to about 0.5 millimeters, and a surface coating comprising at least one silver biocide. The at least one silver biocide is preferably selected from the group consisting of metallic silver and silver compounds.

Preferably, the biocidal particles include a core selected from the group consisting of solid cores and hollow cores. In one embodiment, the solid core is formed from at least one core material selected from the group consisting of metals and metal oxides. In another embodiment, the hollow core is enclosed by a wall formed from glass or a ceramic material.

In one embodiment of the present invention, the exterior coating layer of the algae-resistant granules includes a siliceous coating binder, and optionally, colorants such as metal oxide colorants, and the like. The coating layer can also optionally include latent reactants such as kaolin clay or multi-valent metal ions. In another embodiment of the present invention, the exterior coating layer includes an organic polymeric material as a coating binder.

Preferably, the silver biocide comprises from about 0.005 percent to about 5 percent by weight of the algae-resistant granules, more preferably from about 0.01 percent to about 5 percent by weight of the algae-resistant granules, and still more preferably from about 0.02 percent to about 2 percent by weight of the algae-resistant granules.

Preferably, the silver biocide employed in the algae-resistant roofing granules of the present invention has a surface area of at least 0.5 square meter per gram of biocide, more preferably at least 2 square meter per gram of biocide, and still more preferably at least 5 square meter per gram of biocide.

The present invention also provides a sheet-roofing product, such as asphalt roof shingles or roofing membranes. In one embodiment, a sheet-roofing product according to the present invention includes a bituminous base and algae-resistant roofing granules according to the present invention.

In another embodiment, a sheet-roofing product according to the present invention includes a bituminous base including an upper layer formed from an asphaltic material, and biocidal particles embedded in the upper layer. The embedded biocidal particles are selected from (1) biocidal particles having an average size from about 0.1 micrometers to about 5 millimeters and having a surface coating comprising at least one silver biocide; and (2) microcapsules having an average size from about 200 micrometers and 5 millimeters. Preferably, the microcapsules preferably have capsule walls that are environmentally degradable in a controlled manner, and cores including a plurality of biocidal particles. The biocidal particles preferably have an average size from about 0.1 micrometers to about 0.5 millimeters, and a surface coating comprising at least one silver biocide. The at least one silver biocide is preferably selected from the group consisting of metallic silver and silver compounds. Preferably, the biocidal particles include a core selected from the group consisting of solid cores and hollow cores. In one embodiment, the solid core is formed from at least one core material selected from the group consisting of metals and metal oxides. In another embodiment, the hollow core is enclosed by a wall formed from an inorganic or organic glass, a semi crystalline material, a ceramic material, or a ceramer material.

In this embodiment, the biocidal particles are preferably embedded in the upper layer at a loading of from about 1 to about 200, preferably from about 5 to about 50, milligrams of biocidal particles per square centimeter of the surface of the upper layer. In this embodiment, the biocidal particles preferably have a surface area of at least about 10 square meter per square meter of the surface of the upper layer. Preferably, the biocidal particles are embedded in the upper layer such that at least sixty percent of the biocidal particles are exposed on the top surface of the upper layer. More preferably, the biocidal particles have an exposed surface area of at least about 10 square meter per square meter of the surface of the upper layer.

In yet another embodiment, a sheet-roofing product according to the present invention includes a bituminous base including an upper layer formed from an asphaltic material, and a surface coating applied to the upper layer. The surface coating includes biocidal particles which are selected from (1) biocidal particles having an average size from about 0.1 micrometers to about 5 millimeters and having a surface coating comprising at least one silver biocide; and (2) microcapsules having an average size from about 200 micrometers and 5 millimeters. Preferably, the microcapsules preferably have capsule walls that are environmentally degradable in a controlled manner, and cores including a plurality of biocidal particles. The biocidal particles preferably have an average size from about 0.1 micrometers to about 0.5 millimeters, and a surface coating comprising at least one silver biocide. The at least one silver biocide is preferably selected from the group consisting of metallic silver and silver compounds. Preferably, the biocidal particles include a core selected from the group consisting of solid cores and hollow cores. In one embodiment, the solid core is formed from at least one core material selected from the group consisting of metals and metal oxides. In another embodiment, the hollow core is enclosed by a wall formed from an organic or inorganic glass, a semi crystalline material, a ceramic material, or a ceramer material.

In this embodiment, the biocidal particles are preferably embedded in the surface coating at a loading of from about 0.1 to about 200, preferably from about 15 to 10, more preferably from about 3 to about 50 milligrams of biocidal particles per square centimeter of the exposed surface of the surface coating. In this embodiment, the biocidal particles preferably have a surface area of at least 10 square cm per square centimeter of the exposed surface of the surface coating. In one embodiment, the surface coating includes a binder subject to controlled environmental degradation. In another embodiment, the surface coating is preferably formed from a material resistant to environmental degradation. The surface coating can include a polymeric binder, such as a polymeric binder formed from a poly(meth)acrylate, polyurethane or polyurea. The surface coating can also include material to impart solar heat reflectance, including a reflective pigment such as titanium dioxide. In one presently preferred embodiment, the surface coating includes a transparent binder, such as a suitable poly(meth)acrylate, and biocidal particles are selected to minimize the opacity or turbidity of the surface coating, such as by selecting biocidal particles smaller than about 400 nm.

The present invention also provides a process for preparing algae-resistant granules. In the present process, base particles comprising inert material are provided, and coated with an exterior coating composition. The exterior coating composition comprises biocidal particles selected from the group consisting of (1) biocidal particles having an average size from about 0.1 micrometers to about 5 millimeters and having a surface coating comprising at least one silver biocide selected from the group consisting of metallic silver and silver compounds; and (2) microcapsules having an average size from about 200 micrometers and 5 millimeters. The capsule wall is preferably environmentally degradable in a controlled manner, and the capsule core includes a plurality of biocidal particles having an average size from about 0.1 micrometers to about 0.5 millimeters and having a surface coating comprising at least one silver biocide selected from the group consisting of metallic silver and silver compounds. The exterior coating composition is then cured. Preferably, the exterior coating composition is cured at temperature low enough to avoid oxidizing the silver or silver compound(s). Preferably, the exterior coating composition is cured at a temperature less than about 300 degrees Celsius. In the alternative, or in addition, the exterior coating composition is cured in a non-oxidizing atmosphere, in order to avoid, reduce, or minimize the potential extent of oxidation of the silver or silver compound(s).

The algae-resistant granules prepared according to the process of the present invention can be employed in the manufacture of algae-resistant roofing products, such as algae-resistant asphalt shingles or roofing membranes. The algae-resistant granules of the present invention can be mixed with conventional roofing granules, and the granule mixture can be embedded in the surface of bituminous or other roofing products using conventional methods. Alternatively, the algae-resistant granules of the present invention can be substituted for conventional roofing granules in manufacture of bituminous roofing products, such as asphalt roofing shingles or roofing membranes, to provide those roofing products with algae-resistance.

It is an object of the present invention to provide a process for preparing roofing shingles to have algae-resistance that can be customized to the specific geographic region in which the shingles are intended to be used.

It is a further object of the present invention to provide algae-resistant roofing granules having controllable levels of algaecide release.

It is a further object of the present invention to provide algae-resistant asphalt shingles.

These and other objects of the invention will become apparent through the following description and claims.

DETAILED DESCRIPTION

Figure 1:
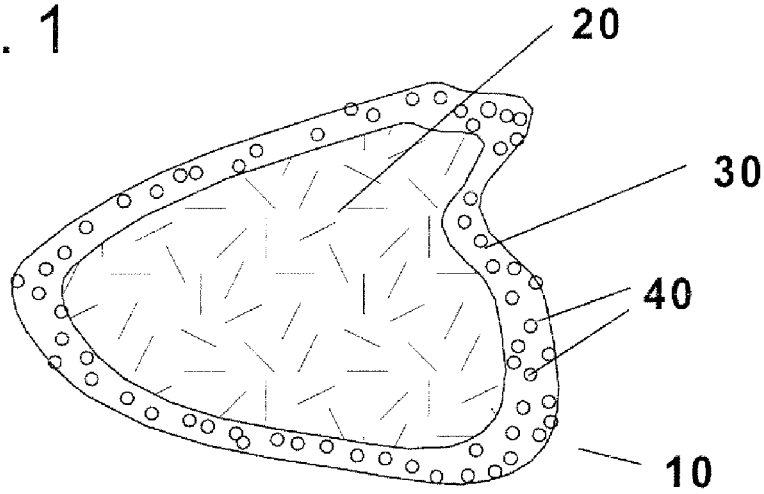
FIG. 1 is a schematic representation of a first type of an algae-resistant granule of the present invention.

The algae-resistant roofing granules of the present invention can be prepared through traditional granule preparation methods, such as those disclosed in U.S. Pat. No. 2,981,636, incorporated herein by reference.

The base particles employed in the process of preparing the algae-resistant granules of the present invention are preferably chemically inert materials, such as inert mineral particles. The mineral particles, which can be produced by a series of quarrying, crushing, and screening operations, are generally intermediate between sand and gravel in size (that is, between about 8 US mesh and 70 US mesh), and preferably have an average particle size of from about 0.2 mm to about 3 mm, and more preferably from about 0.4 mm to about 2.4 mm.

In particular, suitably sized particles of naturally occurring materials such as talc, slag, granite, silica sand, greenstone, andesite, porphyry, marble, syenite, rhyolite, diabase, greystone, quartz, slate, trap rock, basalt, and marine shells can be used, as well as recycled manufactured materials such as crushed bricks, concrete, porcelain, fire clay, and the like.

In preparing algae-resistant roofing granules according to the present invention, an exterior coating layer is applied to the base particles. The exterior coating layer includes biocidal particles, and preferably includes a suitable coating binder. The coating binder can be an inorganic or organic material, and is preferably formed from a polymeric organic material or a silicaceous material, such as a metal-silicate binder, for example an alkali metal silicate, such as sodium silicate.

When a metal-silicate binder is employed in the preparation of algae-resistant granules of the present invention, the binder preferably includes a heat-reactive aluminosilicate material, such as clay, preferably, kaolin. Alternatively, the metal silicate binder can be insolubilized chemically by reaction with an acidic material, for example, ammonium chloride, aluminum chloride, hydrochloric acid, calcium chloride, aluminum sulfate, and magnesium chloride, such as disclosed in U.S. Pat. Nos. 2,591,149, 2,614,051, 2,898,232 and 2,981,636, each incorporated herein by reference, or other acidic material such as aluminum fluoride. In another alternative, the binder can be a controlled release sparingly water soluble glass such as a phosphorous pentoxide glass modified with calcium fluoride, such as disclosed in U.S. Pat. No. 6,143,318, incorporated herein by reference.

Suitable inert base particles, for example, mineral particles with size passing #8 mesh and retaining on #70 mesh, can be coated with a combination of a metal-silicate binder, kaolin clay, color pigments such as metal oxide pigments to reach desirable colors, and biocidal particles, followed by a heat treatment to obtain a durable coating.

When the coated granules are fired at an elevated temperature, such as at conditions of at least about 800 degrees F., and preferably at temperatures from about 1,000 to about 1,200 degrees F., the clay binder densifies to form strong particles. Preferably, the temperature employed is low enough to avoid oxidation of silver and or silver compounds employed in the biocidal particles.

Examples of clays that can be employed in the process of the present invention include kaolin, other aluminosilicate clays, Dover clay, bentonite clay, etc.

In the alternative, a suitable silicaceous binder can be formed from sodium silicate, modified by the addition of at least one of sodium fluorosilicate, aluminum fluoride, or Portland cement.

The algae-resistant roofing granules of the present invention can be colored using conventional coatings pigments. Examples of coating pigments that can be used include those provided by the Color Division of Ferro Corporation, 4150 East 56th St., Cleveland, Ohio 44101, and produced using high temperature calcinations, including PC-9415 Yellow, PC-9416 Yellow, PC-9158 Autumn Gold, PC-9189 Bright Golden Yellow, V-9186 Iron-Free Chestnut Brown, V-780 Black, V0797 IR Black, V-9248 Blue, PC-9250 Bright Blue, PC-5686 Turquoise, V-13810 Red, V-12600 Camouflage Green, V12560 IR Green, V-778 IR Black, and V-799 Black.

In the alternative, the exterior coating layer can include an organic polymeric material as a coating binder. Suitable organic polymeric materials include poly(meth)acrylates, polyurethanes and polyureas. Such polymeric binders can be substantially amorphous or can be semi-crystalline in nature.

The biocidal particles employed in compositions, articles and processes of the present invention are preferably selected from the group consisting of (1) biocidal particles having an average size from about 0.1 micrometers to about 5 millimeters and having a surface coating comprising at least one silver biocide selected from the group consisting of metallic silver and silver compounds; and (2) microcapsules having an average size from about 200 micrometers and 5 millimeters, and having a capsule wall environmentally degradable in a controlled manner and a core comprising a plurality of biocidal particles having an average size from about 0.1 micrometers to about 0.5 millimeters and having a surface coating comprising at least one silver biocide selected from the group consisting of metallic silver and silver compounds.

The preparation of biocidal particles for use in the present invention is disclosed, for example, in U.S. Pat. Nos. 5,180,585, 5,503,840, and 5,595,750, each of which is incorporated herein by reference. Biocidal particles for use in the present invention are available from AirQual Corporation, 35 Industrial Drive, Canton, Mass. 02021 under the brand name ACT.

The biocidal particles include either a solid core or a hollow core. Examples of solid core materials include fine particles of titanium oxide, aluminum oxide, zinc oxide, cupric oxide, cuprous oxide, calcium sulfate, strontium sulfate, barium sulfate, zeolites, mica, talc, kaolin and silica. When a solid core is employed, the solid core is preferably formed from at least one core material selected from the group consisting of metals and metal oxides. Titanium oxide is especially preferred as a core material. Either anatase or rutile titanium oxide can be used as a material for forming solid cores. Suitable particles with hollow cores can be provided, for example, by microspheres having glass walls enclosing a hollow interior, such as disclosed in U.S. Pat. Nos. 2,978,340, 3,030,215, 3,129,086 3,230,064, 3,365,315, 4,279,632, 4,391,646 and 4,767,726, or ceramic walls enclosing a hollow interior, such as disclosed in U.S. Pat. Nos. 2,978,340, 3,792,136, 4,111,713, 4,744,831, and 5,077,241.

Preferably, the core material is insoluble in water. The core material can have a regular shape, such as, for example, a spherical, ellipsoidal, cubic, rhombohedral, platelet or acicular shape, or an irregular shape. The average particle size of the core material can range from about 0.01 micrometers to about 100 micrometers, preferably from about 0.1 micrometer to about 5 micrometers. Preferably, the core material has a specific surface area of from about 0.1 square meters per gram to about 100 square meters per gram of core material.

The silver biocide is preferably selected from metallic silver and silver compounds, such as silver oxide, silver chloride, silver bromide, silver iodide. Mixtures of silver and/or silver compounds with one or more other biocidal materials, such as, for example, copper, cuprous oxide, cupric acetate, cupric chloride, cupric nitrate, cupric oxide, cupric sulfate, cupric sulfide, cupric stearate, cupric cyanide, cuprous cyanide, cuprous stannate, cuprous thiocyanate, cupric silicate, cuprous chloride, cupric iodide, cupric bromide, cupric carbonate, cupric fluoroborate, zinc oxide, such as French process zinc oxide, zinc sulfide, zinc borate, zinc sulfate, zinc pyrithione, zinc ricinoleate, zinc stearate, zinc chromate, zinc carbonate, and mixtures thereof. Silver alloys, such as alloys of silver and copper, and alloys of silver and zinc, can also be employed.

The silver biocide preferably comprises from about 0.05 percent to 40 percent, more preferably form about 0.1 percent to about 15 percent by weight of the core material.

The silver biocide is deposited as a coating layer on the core material, such as, for example, by precipitation, and is in turn preferably coated with a protective coating such as silica or alumina or an aluminosilicate, preferably such that the protective coating comprises from about 0.5 percent to about 20 percent, more preferably from about 1 to about 5 percent by weight of the biocidal particles. Preferably, the protective coating is sufficiently porous to permit diffusion of the silver biocide through the protective coating. In order to increase the dispersability of the biocidal particles, the isoelectric point of the particles can be adjusted, such as by the addition of one or more supplemental exterior coating layers, to provide an isoelectric point between about 5.5 and 9.5. The supplemental exterior coating layer can be provided by a coating of a hydrous metal oxide such as alumina, magnesia, or zirconia. The resulting biocidal particles are preferably dried and, if necessary, processed to provide a fine powder, such as by milling. A dispersing agent such as an organic ester, a polyol, or polyester oligomer can be employed to aid in providing a finely divided powder of biocidal particles.

In one presently preferred embodiment, the biocidal particles are preferably mixed directly with the binder of the exterior coating composition, along with suitable colorants, pigments, et al., and the exterior coating composition can then be applied to the base particles by a conventional technique. In another presently preferred embodiment, the biocidal particles are first encapsulated in microcapsules, and the microcapsules are in turn dispersed in the exterior coating composition. In either case, the coating composition is then cured to provide the algae-resistant roofing granules of the present invention. The composition of the exterior coating of the algae-resistant roofing granules and the curing method are preferably selected to minimize oxidation of the silver biocide, when a non-oxide biocide such as metallic silver is employed as the silver biocide.

The finely divided powder of biocidal particles can be encapsulated in microcapsules using conventional techniques for forming microcapsules, including such techniques as interfacial polymerization, phase separation/coacervation, spray drying, spray coating, fluid bed coating, supercritical anti-solvent precipitation, and the like. Techniques for microencapsulating solid biocidal particles and other solid particles are disclosed, for example, in G. Beestman, "Microencapsulation of Solid Particles," Controlled-Release Delivery Systems for Pesticides, (H. B. Scher, Ed., Marcel Dekker, Inc. New York 1999) pp. 31-54, Kirk-Othmer Encyclopedia of Chemical Technology, 4th Edition; as well in U.S. Pat. Nos. 6,156,245, 6,797,277, and 6,861,145. Preferably, the microcapsules formed have an average size of from about 200 micrometers to about 5 millimeters, and more preferably of from about 400 micrometers to about 2 mm. Preferably, the microcapsules are formed from a material that provides capsule walls that are environmentally degradable in a controlled manner. Such controlled release microcapsules are well known in the pharmaceutical and agrochemical arts. A variety of mechanisms can be employed to provide such capsules. For example, the capsule wall can include additive to increase their sensitivity to environmental degradation, such as disclosed in U.S. Pat. No. 6,936,644 (IR sensitivity). Preferably, the microcapsules are formulated to provide controlled release of the biocidal particles from the microcapsules over an extended period. A mixture of microcapsules having differing time-release characteristics can be employed, so that there is a continuous release of biocide over an extended period of time, such as, for example, over the anticipated life of the roofing product.

The proportion of biocidal particles in the algae-resistant roofing granules can be adjusted depending on a number of factors, such as the intended use of the roofing products manufactured using the algae-resistant granules, the expected environmental conditions at the site where the roofing products including the algae-resistant granules are to be installed, the proportion of silver biocide in the biocidal particles, the porosity of the protective layer of the biocidal particles, the porosity of the exterior coating composition of the roofing granules, the proportion of algae-resistant roofing granules to conventional non-algae-resistant roofing granules employed in the roofing product, et al. In general, however, the proportion of biocidal particles mixed in the exterior coating composition is preferably selected to provide algae-resistant roofing granules in which the biocidal particles comprise from about 0.005 to about 5 percent by weight of the granules. Preferably, the proportion of biocidal particles in the exterior coating composition is selected to provide algae-resistant roofing granules in which the biocidal particles have a surface area of from about 0.05 to about 3, preferably from about 0.1 to about 2, more preferably from about 0.5 to about 1 square meter per gram of algae-resistant roofing granules.

The algae resistance properties of the algae-resistant roofing granules of the present invention are determined by a number of factors, including the porosity of the surface coating of the roofing granules, the nature and amount(s) of the biocide employed, and the spatial distribution of the algaecide in the coating of the granules.

The process of the present invention advantageously permits the algae resistance of the shingles employing the algae-resistant granules to be tailored to specific local conditions. For example, in geographic areas encumbered with excessive moisture favoring rapid algae growth, the granules can be structured to release the relatively high levels of algaecide required to effectively inhibit algae growth under these conditions. Conversely, where algae growth is less favored by local conditions, the granules can be structured to release the lower levels of algaecide effective under these conditions.

In another embodiment of the present invention, silver-containing biocidal particles such as describe above are embedded in the upper layer of a roofing product including a bituminous base. In this embodiment, a sheet roofing product, such as asphalt roofing shingles or asphaltic roll roofing stock, including a bituminous base including an upper layer formed from an asphaltic material. The upper layer typically covers a lower layer in which a fibrous web is embedded, such as a web of glass reinforcing fibers. In this embodiment, biocidal particles are embedded in the upper layer. The biocidal particles can be embedded by using a conventional process. For example, the biocidal particles can be dusted on top of the upper layer shortly after application of the asphaltic material to a glass fiber web, while the asphaltic material is still in a fluid or semi-solid state, so that the biocidal particles adhere to the asphaltic material of the upper layer and become embedded therein when the upper layer has cooled sufficiently. The biocidal particles can be applied before roofing granules, such as conventional coloring granules, or a mixture of coloring granules and algae-resistant granules, are applied to the upper layer in order to adhere the roofing granules.

In yet another embodiment of the present invention, silver-containing biocidal particles such as described above are dispersed in a fluid coating composition, and the coating composition is applied to the intended exterior surface of a roofing product such as asphaltic roofing shingles, asphaltic roll roofing stock, or the like. The coating composition is then cured to provide a coating including the silver-containing biocidal particles over the upper surface of the roofing product. In this case, the coating composition can be applied either before or after roofing granules have been applied to the surface. Preferably, the coating composition is applied after the roofing granules have been applied. The coating composition also preferably includes a uv-resistant film-forming binder such as a poly(methacrylate) with a suitable glass transition temperature, as well as, optionally, suitable coalescents, solvents, plasticizers, pigments, colorants, and the like.

In another aspect of the present invention, a fluid coating composition containing biocidal particles such as described above is applied to the upper layer of a roofing product including a bituminous base, such as asphalt roofing shingle stock, before the addition of roofing granules to the roofing product.

Referring now to the drawings, in which like reference numeral refer to like elements in each of the several views, there is shown in FIGS. 1, 2, 3 and 4 schematically examples of algae-resistant granules prepared according to the process of the present invention.

FIG. 1 is a schematic representation of a first type of an algae-resistant granule of the present invention. FIG. 1 schematically illustrates an algae-resistant granule 10 formed from an inert mineral base particle 20 covered with an exterior coating layer 30 in which are distributed biocidal particles 40.

Figure 2:
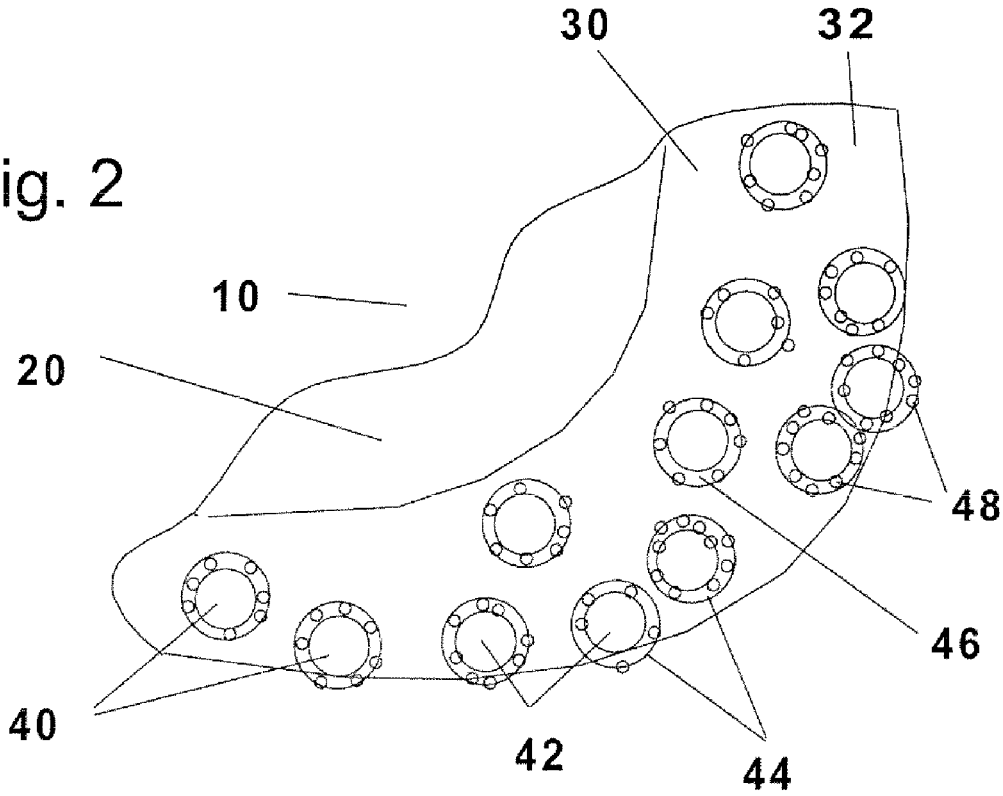
FIG. 2 is a fragmentary, expanded schematic representation of the algae-resistant granule of FIG. 1.

FIG. 2 is a fragmentary, expanded schematic representation of the algae-resistant granule 10 of FIG. 1. The exterior coating layer 30 on the base particle 20 includes an exterior coating composition 32 in which the biocidal particles 40 are dispersed. The biocidal particles 40 include a particle core 42 covered with a particle surface coating layer 44 formed from a surface coating composition 46 containing silver biocide 48, such as metallic silver, dispersed in a surface coating composition 46.

Figure 3:
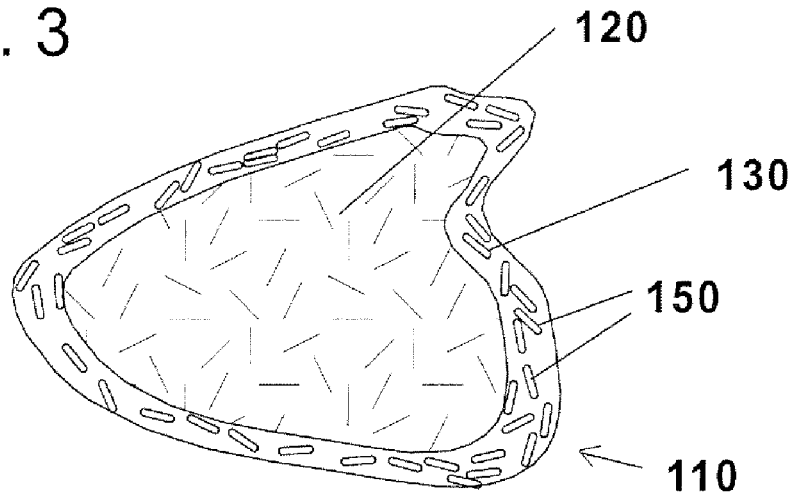
FIG. 3 is a schematic representation of a second type of an algae-resistant granule of the present invention.

FIG. 3 is a schematic representation of a second type of an algae-resistant granule 110 of the present invention. FIG. 3 schematically illustrates an algae-resistant granule 110 formed from an inert mineral base particle 120 covered with an exterior coating layer 130 in which are distributed microcapsules 150 including biocidal particles.

Figure 4:
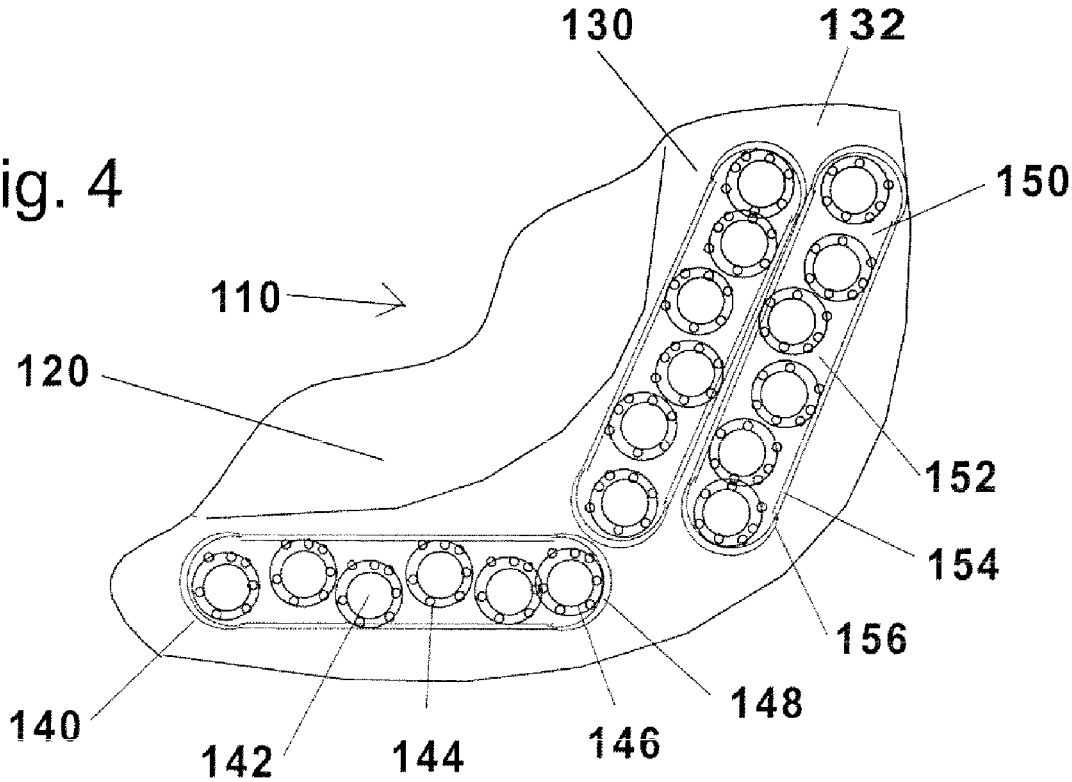
FIG. 4 is a fragmentary, expanded schematic representation of the algae-resistant granule of FIG. 3.

FIG. 4 is a fragmentary, expanded schematic representation of the algae-resistant granule 110 of FIG. 3. The exterior coating layer 130 includes an exterior coating composition 132 in which the microcapsules 150 including a wall 154 enclosing a hollow core 152 in which the biocidal particles 140 are dispersed. The wall 154 of the microcapsules 150 is optionally covered with a suitable surface coating 156. The biocidal particles 140 include a particle core 142 covered with a particle surface coating layer 144 containing silver biocide 148, such as silver oxide, dispersed in a surface coating composition 146.

Figure 5:
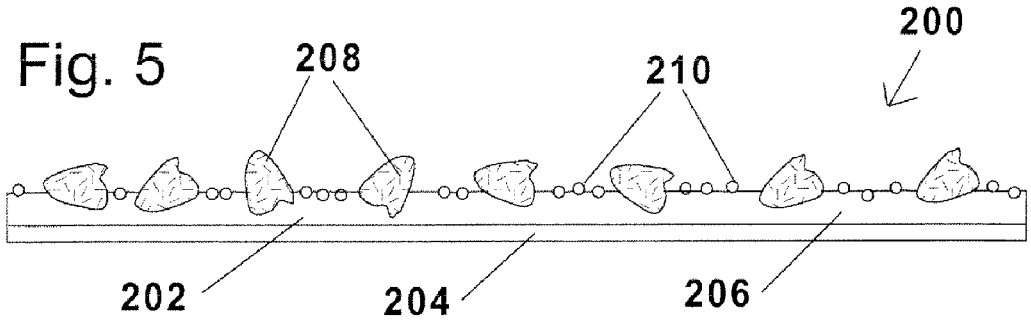
FIG. 5 is a fragmentary schematic representation of a first type of algae-resistant roofing product according to the present invention.

FIG. 5 is a fragmentary schematic representation of a first type of algae-resistant roofing product or shingle 200 according to the present invention. In this algae-resistant roofing product 200 a base 202 including a lower layer 204 comprising a reinforcing web of glass fibers (not shown) saturated with a bituminous material is covered with a bituminous upper layer 206. A plurality of roofing granules 208 are embedded in the upper layer 206, as well as a plurality of silver-containing biocidal particles 210.

Figure 6:
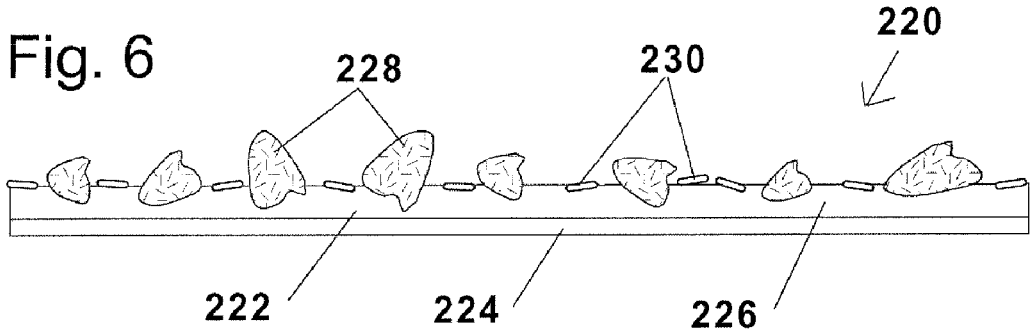
FIG. 6 is a fragmentary schematic representation of a second type of algae-resistant roofing product according to the present invention.

FIG. 6 is a fragmentary schematic representation of a second type of algae-resistant roofing product 220 according to the present invention. In this algae-resistant roofing product 220 a base 222 including a lower layer 224 comprising a reinforcing web of glass fibers (not shown) saturated with a bituminous material is covered with a bituminous upper layer 226. A plurality of roofing granules 228 are embedded in the upper layer 226, as well as a plurality of microcapsules 230 containing silver-containing biocidal particles.

Figure 7:
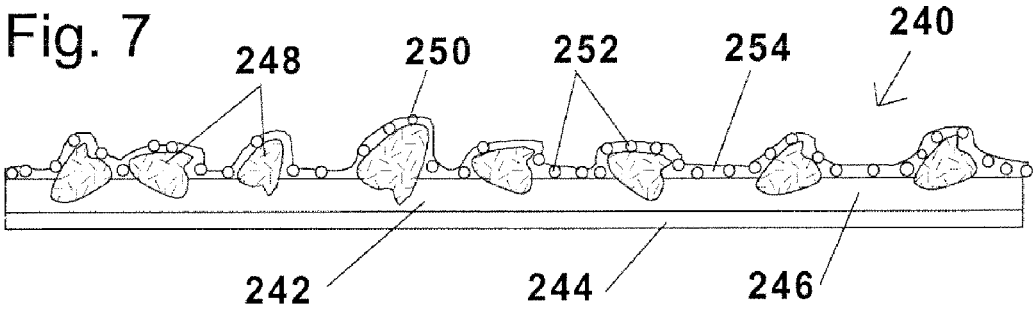
FIG. 7 is a fragmentary schematic representation of a third type of algae-resistant roofing product according to the present invention.

FIG. 7 is a fragmentary schematic representation of a third type of algae-resistant roofing product 240 according to the present invention. In this algae-resistant roofing product 240 a base 242 including a lower layer 244 comprising a reinforcing web of glass fibers (not shown) saturated with a bituminous material is covered with a bituminous upper layer 246. A plurality of roofing granules 248 are embedded in the upper layer 246. A surface coating 250 including a surface coating binder 254 and containing a plurality of silver-containing biocidal particles 252 cover the upper surface of upper layer 246 and the otherwise exposed exterior surfaces of the roofing granules 248.

The present invention also provides a process for the manufacture of algae-resistant roofing granules. In this process base particles comprising inert material are provided, and then the base particles are coated with an exterior coating composition. The exterior coating composition includes biocidal particles. The biocidal particles are selected from the group consisting of (1) biocidal particles having an average size from about 0.1 micrometers to about 5 millimeters and having a surface coating comprising at least one silver biocide selected from the group consisting of metallic silver and silver compounds; and (2) microcapsules having an average size from about 200 micrometers and 5 millimeters, and having a capsule wall environmentally degradable in a controlled manner and a core comprising a plurality of biocidal particles having an average size from about 0.5 micrometers to about 0.5 millimeters and having a surface coating comprising at least one silver biocide selected from the group consisting of metallic silver and silver compounds. Next, the exterior coating composition is cured.

The exterior coating composition can include a silicaceous binder such as silica. The exterior coating composition is preferably cured under conditions such that the biocidal effectiveness of the silver biocide is not significantly degraded. Thus, for example, when the silver biocide is metallic silver, elevated temperatures and/or oxidizing conditions that would tend to oxide the metallic silver are to be avoided. Thus, for example, when silica is employed as the binder for the exterior coating composition, chemical curing agents, such as acidic materials, for example, aluminum fluoride, or reduced cure temperatures, or a combination of reduced cure temperature and a suitable chemical curing agent, can be employed. Preferably, the exterior coating composition is cured at temperature less than about 300 degrees Celsius. Thus, preferably, the exterior coating composition is cured in an inert or a non-oxidizing atmosphere, such as a nitrogen atmosphere.

The exterior coating composition used in preparing the algae-resistant granules can include other components, such as conventional metal oxide colorants of the type employed in the manufacture of roofing granules, solar heat-reflective pigments such as titanium dioxide, other biocidal materials, and the like.

The algae-resistant granules prepared according to the process of the present invention can be employed in the manufacture of algae-resistant roofing products, such as algae-resistant asphalt shingles, using conventional roofing production processes. Typically, bituminous roofing products are sheet goods that include a non-woven base or scrim formed of a fibrous material, such as a glass fiber scrim. The base is coated with one or more layers of a bituminous material such as asphalt to provide water and weather resistance to the roofing product. One side of the roofing product is typically coated with mineral granules to provide durability, reflect heat and solar radiation, and to protect the bituminous binder from environmental degradation. The algae-resistant granules of the present invention can be mixed with conventional roofing granules, and the granule mixture can be embedded in the surface of such bituminous roofing products using conventional methods. Alternatively, the algae-resistant granules of the present invention can be substituted for conventional roofing granules in the manufacture of bituminous roofing products to provide those roofing products with algae-resistance.

Bituminous roofing products are typically manufactured in continuous processes in which a continuous substrate sheet of a fibrous material such as a continuous felt sheet or glass fiber mat is immersed in a bath of hot, fluid bituminous coating material so that the bituminous material saturates the substrate sheet and coats at least one side of the substrate. The reverse side of the substrate sheet can be coated with an anti-stick material such as a suitable mineral powder or a fine sand. Roofing granules are then distributed over selected portions of the top of the sheet, and the bituminous material serves as an adhesive to bind the roofing granules to the sheet when the bituminous material has cooled. The sheet can then be cut into conventional shingle sizes and shapes (such as one foot by three feet rectangles), slots can be cut in the shingles to provide a plurality of "tabs" for ease of installation, additional bituminous adhesive can be applied in strategic locations and covered with release paper to provide for securing successive courses of shingles during roof installation, and the finished shingles can be packaged. More complex methods of shingle construction can also be employed, such as building up multiple layers of sheet in selected portions of the shingle to provide an enhanced visual appearance, or to simulate other types of roofing products.

The bituminous material used in manufacturing roofing products according to the present invention is derived from a petroleum processing by-product such as pitch, "straight-run" bitumen, or "blown" bitumen. The bituminous material can be modified with extender materials such as oils, petroleum extracts, and/or petroleum residues. The bituminous material can include various modifying ingredients such as polymeric materials, such as SBS (styrene-butadiene-styrene) block copolymers, resins, oils, flame-retardant materials, oils, stabilizing materials, anti-static compounds, and the like. Preferably, the total amount by weight of such modifying ingredients is not more than about 15 percent of the total weight of the bituminous material. The bituminous material can also include amorphous polyolefins, up to about 25 percent by weight. Examples of suitable amorphous polyolefins include atactic polypropylene, ethylene-propylene rubber, etc. Preferably, the amorphous polyolefins employed have a softening point of from about 130 degrees C. to about 160 degrees C. The bituminous composition can also include a suitable filler, such as calcium carbonate, talc, carbon black, stone dust, or fly ash, preferably in an amount from about 10 percent to 70 percent by weight of the bituminous composite material.

The following example is provided to better disclose and teach processes and compositions of the present invention. The example is for illustrative purposes only, and it must be acknowledged that minor variations and changes can be made without materially affecting the spirit and scope of the invention as recited in the claims that follow.

EXAMPLE 1

Roofing granules with a surface coating containing a silver compound were produced by mixing together the following ingredients together in a paddle mixer for 2-3 minutes: 500 g of crushed and screened rhyolite igneous rock from Piedmont, Mo. having an average particle size of 1 mm, 19 g of aqueous sodium silicate (40% solids, with $Na_2O:SiO_2$ ratio of 1:3.2), 1.4 g of aluminum fluoride, 0.4 g of sodium fluorosilicate, 0.4 g of Portland cement, and 2.3 g of silver compound AQ 200 (silver coated zinc oxide particles depicted in FIG. 1, average particle size 1 micrometers, from AirQual Corporation, Canton, Mass.). The granules were fired at 230° C. for 20 minutes to form algae resistant roofing granules with silver on the surface layer.

Various modifications can be made in the details of the various embodiments of the processes, compositions and articles of the present invention, all within the scope and spirit of the invention and defined by the appended claims.

The invention claimed is:

1. Algae-resistant roofing granules comprising:

(a) a base particle comprising an inert mineral;

(b) an exterior coating layer on the base particle, the exterior coating including biocidal particles selected from the group consisting of:

(1) biocidal particles having an average size from about 0.1 micrometers to about 5 millimeters and having a surface coating comprising at least one silver biocide selected from the group consisting of metallic silver and silver compounds; and (2) microcapsules having an average size from about 200 micrometers and 5 millimeters, and having a capsule wall environmentally degradable in a controlled manner and a core comprising a plurality of biocidal particles having an average size from about 0.1 micrometers to about 0.5 millimeters, the biocidal particles having a surface coating comprising at least one silver biocide selected from the group consisting of metallic silver and silver compounds.

2. Algae-resistant roofing granules according to claim 1 wherein the biocidal particles materials include a core selected from the group consisting of:

(a) solid cores, the solid core being formed from at least one core material selected from the group consisting of metals and metal oxides, and (b) hollow cores enclosed by a wall formed from glass or a ceramic material.

3. Algae-resistant roofing granules according to claim 1 wherein the exterior coating layer includes a binder selected from the group consisting of silicaceous coating binders and organic polymeric materials.

4. Algae-resistant roofing granules according to claim 1 wherein the silver biocide comprises from about 0.005 percent to about 5 percent by weight of the granules.

5. Algae-resistant roofing granules according to claim 1 wherein the silver biocide has a surface area of at least 1 square meter per gram of biocide.

6. A sheet roofing product including a bituminous base and algae-resistant roofing granules, the granules comprising:

(a) a base particle comprising an inert mineral;

(b) an exterior coating layer on the base particle, the exterior coating including biocidal particles selected from the group consisting of:

(1) biocidal particles having an average size from about 0.1 micrometers to about 5 millimeters and having a surface coating comprising at least one silver biocide selected from the group consisting of metallic silver and silver compounds; and (2) microcapsules having an average size from about 200 micrometers and 5 millimeters, and having a capsule wall environmentally degradable in a controlled manner and a core comprising a plurality of biocidal particles having an average size from about 0.1 micrometers to about 0.5 millimeters, the biocidal particles having a surface coating comprising at least one silver biocide selected from the group consisting of metallic silver and silver compounds.

7. A sheet roofing product according to claim 6 wherein the biocidal particles include a core selected from the group consisting of:

(a) solid cores, the solid core being formed from at least one core material selected from the group consisting of metals and metal oxides, and (b) hollow cores enclosed by a wall formed from glass or a ceramic material.

8. A sheet roofing product according to claim 6 wherein the exterior coating layer includes a binder selected from the group consisting of silicaceous coating binders and organic polymeric materials.

9. A sheet roofing product according to claim 6 wherein the silver biocide comprises from about 0.005 percent to about 5 percent by weight of the granules.

10. A sheet roofing product according to claim 6 wherein the silver biocide has a surface area of at least 1 square meter per gram of biocide.

11. A sheet roofing product including:

(a) a bituminous base including an upper layer formed from an asphaltic material, and (b) biocidal particles embedded in the upper layer, the biocidal particles being selected from the group consisting of:

(1) biocidal particles having an average size from about 0.1 micrometers to about 5 millimeters and having a surface coating comprising at least one silver biocide selected from the group consisting of metallic silver and silver compounds; and (2) microcapsules having an average size from about 200 micrometers and 5 millimeters, and having a capsule wall environmentally degradable in a controlled manner and a core comprising a plurality of biocidal particles having an average size from about 0.1 micrometers to about 0.5 millimeters, the biocidal particles having a surface coating comprising at least one silver biocide selected from the group consisting of metallic silver and silver compounds.

12. A sheet roofing product according to claim 11 wherein the biocidal particles include a core selected from the group consisting of:

(a) solid cores, the solid core being formed from at least one core material selected from the group consisting of metals and metal oxides, and (b) hollow cores enclosed by a wall formed from glass or a ceramic material.

13. A sheet roofing product according to claim 11 wherein the exterior coating layer includes a binder selected from the group consisting of silicaceous coating binders and organic polymeric materials.

14. A sheet roofing product according to claim 11 wherein the silver biocide has a surface area of at least 1 square meter per gram of biocide.

15. A sheet roofing product including:

(a) a bituminous base including an upper layer formed from an asphaltic material, and (b) a surface coating applied to the upper layer, the surface coating including biocidal particles selected from the group consisting of:

(1) biocidal particles having an average size from about 0.1 micrometers to about 5 millimeters and having a surface coating comprising at least one silver biocide selected from the group consisting of metallic silver and silver compounds; and (2) microcapsules having an average size from about 200 micrometers and 5 millimeters, and having a capsule wall environmentally degradable in a controlled manner and a core comprising a plurality of biocidal particles having an average size from about 0.5 micrometers to about 0.5 millimeters, the biocidal particles having a surface coating comprising at least one silver biocide selected from the group consisting of metallic silver and silver compounds.

16. A sheet roofing product according to claim 15 wherein the biocidal particles include a core selected from the group consisting of:

(a) solid cores, the solid core being formed from at least one core material selected from the group consisting of metals and metal oxides, and (b) hollow cores enclosed by a wall formed from glass or a ceramic material.

17. A sheet roofing product according to claim 15 wherein the exterior coating layer includes a binder selected from the group consisting of silicaceous coating binders and organic polymeric materials.

18. A sheet roofing product according to claim 15 wherein the surface coating includes a binder subject to controlled environmental degradation.

19. A sheet roofing product according to claim 15 wherein the silver biocide has a surface area of at least 1 square meter per gram of biocide.

20. A process for preparing algae-resistant roofing granules, the process comprising:

(a) providing base particles comprising inert material;

(b) coating the base particles with an exterior coating composition, the exterior coating composition comprising biocidal particles selected from the group consisting of:

(1) biocidal particles having an average size from about 0.1 micrometers to about 5 millimeters and having a surface coating comprising at least one silver biocide selected from the group consisting of metallic silver and silver compounds; and (2) microcapsules having an average size from about 200 micrometers and 5 millimeters, and having a capsule wall environmentally degradable in a controlled manner and a core comprising a plurality of biocidal particles having an average size from about 0.1 micrometers to about 0.5 millimeters, the biocidal particles having a surface coating comprising at least one silver biocide selected from the group consisting of metallic silver and silver compounds; and (c) curing the exterior coating composition.

21. A sheet roofing product according to claim 12 wherein the core is selected from the group consisting of titanium dioxide and zinc oxide.

22. A sheet roofing product according to claim 16 wherein the core is selected from the group consisting of titanium dioxide and zinc oxide.

* * * * *